US005514737A

United States Patent [19]

Sano et al.

[11] Patent Number: 5,514,737

[45] Date of Patent: May 7, 1996

[54] FIBER TREATMENT COMPOSITION, FIBER TREATED THEREBY, AND A METHOD OF TREATING FIBER THEREBY

[75] Inventors: Masahiro Sano; Shigeru Ohyama; Fumioki Fukatsu, all of Himeji, Japan

[73] Assignee: Idemitsu Petrochemical Co., Ltd., Tokyo, Japan

[21] Appl. No.: 345,558

[22] Filed: Nov. 28, 1994

Related U.S. Application Data

[63] Continuation of Ser. No. 17,810, Feb. 16, 1993, abandoned.

[30] Foreign Application Priority Data

Feb. 19, 1992 [JP] Japan ..... 4-069762

[51] Int. Cl.[6] ..... C08L 89/00

[52] U.S. Cl. ..... 524/10; 524/12; 524/21; 524/34; 524/35; 524/588

[58] Field of Search ..... 524/10, 12, 21, 524/34, 35, 588

[56] References Cited

U.S. PATENT DOCUMENTS

| | | | |
|---|---|---|---|
| 4,350,723 | 9/1982 | Sugimura et al. | 524/11 |
| 4,631,226 | 12/1986 | Jellinek | 523/420 |
| 4,703,075 | 10/1987 | Egami | 524/269 |
| 4,769,405 | 9/1988 | Konda et al. | 524/35 |
| 4,980,403 | 12/1990 | Bateman et al. | 524/17 |
| 5,134,178 | 7/1992 | Nishihori et al. | 524/11 |

FOREIGN PATENT DOCUMENTS

| | | | |
|---|---|---|---|
| 0413627A3 | 2/1991 | European Pat. Off. . | |
| 0421450A2 | 4/1991 | European Pat. Off. . | |
| 0470399A2 | 2/1992 | European Pat. Off. . | |
| 0494381A1 | 7/1992 | European Pat. Off. . | |
| 2007927 | 1/1970 | France . | |
| 1109137 | 6/1961 | Germany . | |
| 5-59400 | 3/1993 | Japan | 524/17 |
| 1265063 | 3/1972 | United Kingdom . | |

OTHER PUBLICATIONS

6001 Chemical Abstracts, Jul. 1991 No. 114:248971d JP 03 45784, Soft moisture–permeable synthetic leather containing silk powder; Masuo Hosokawa et al. (Hosokawa Micron Corp.).

Database WPIL, Week 8751 Derwent Publications, Ltd., London, Great Britain; AN 87–359920, & JP–A–62 263 384, Nov., 1987 *Abstract*.

Database WPIL, Derwent Publications Ltd., London, Great Britain, AN 83–738958, & JP–A–58 117 299, Jul., 1983 *Abstract*.

*Primary Examiner*—Mark D. Sweet
*Attorney, Agent, or Firm*—Flynn, Thiel, Boutell & Tanis

[57] ABSTRACT

A fiber treatment composition containing a synthetic resin such as a silicon resin emulsion, a polyurethane resin emulsion and the like and a pulverized hydrophilic organic group natural material such as collagen. A fiber treated by using the treatment composition. A method of treating the fiber by stirring the fiber treatment composition in a ball mill or the like, soaking a fiber in the composition by the pad method, and drying the fiber under a temperature from 80 to 160 degrees.

16 Claims, 1 Drawing Sheet

FIBER TREATMENT COMPOSITION, FIBER TREATED THEREBY, AND A METHOD OF TREATING FIBER THEREBY

This application is a continuation of U.S. Ser. No. 08/017,810, filed Feb. 16, 1993 now abandoned.

BACKGROUND OF THE INVENTION

1. Field of the Invention

This invention is broadly concerned with a fiber treatment composition, a fiber treated by the composition and a method of treating the fiber by means of the composition and is intended particularly to be used on cloths like stockings, leather products made of vinyl chloride resin, leather products of synthetic or artificial leather, ground cloth of the leather products, and upholstery for automobiles.

2. Description of the Related Art

A fiber treatment process using a composition containing silicon resin, polyurethane resin, polyacrylic group resin, or fluorine group resin has previously been know to impart flexibility or elasticity to fibers or plain cloth and to prevent wrinkling of plain cloth. In a super-soft processing treatment, the silicon resin and the polyurethane resin are generally employed as main resins to obtain the desired texture. Giving an example, amino-denatured silicon is commonly used in the art as being excellent for softening fibers or plain cloth and giving fine soft feeling, draping feeling and stretch back characteristics. For the purpose of giving a volume, elasticity and dry feeling, the polyurethane resin is also utilized.

However, it is also noted that an amino-denatured silicon group finisher tends to hardly block hygroscopic properties of fibers and cloth. Other treatment compositions containing ethylene oxide or an emulsifying agent are utilized to obtain a desired hygroscopic property but do not achieve durability or tend to badly influence flexibility. A treatment composition containing a methyl group in order to improve durability is also well known in the art, but it is not suitable for use with plain cloth worn next to the skin as it includes formalin. From these viewpoints, a general softening agent for obtaining the desired hygroscopic property or a hard softening agent for obtaining dry feeling are often used together.

It is an object of the present invention to provide a fiber treatment composition capable of giving a fiber/cloth a comfortable, dry feeling like a natural fiber/cloth, fine hygroscopic property and durability, and to provide a fiber/cloth treated by the treatment composition and a preferable method of processing a fiber/cloth by using the treatment composition.

SUMMARY OF THE INVENTION

The present invention relates to a fiber treatment composition containing a synthetic resin emulsion and a pulverized hydrophilic organic natural material.

The applicable synthetic resin emulsions are a silicon resin emulsion, a polyurethane resin emulsion, a polyacrylic resin emulsion or a fluorine resin emulsion or mixtures thereof. The silicon resin emulsion is preferably amino-denatured. A solid matter of the resin will be stable in a film form. These resin are superior to decrease the fallen-off quantity of the pulverized hydrophilic organic natural material. The general amino-denatured silicon amino-denatured is stable in an oiled state. The amino-denatured emulsion changes into a film shape and shows better texture, adhesion and washing proof than that of the oiled amino-denatured emulsion.

The pulverized hydrophilic organic natural material includes pulverized animal protein such as collagen, elastin, silk powder and sponge powder and wool, and further includes pulverized plants like cellulose, such as cotton, hemp, pulp and seaweed. The particles of these pulverized material have a standard deviation of 3 micrometers and an average diameter of no more than 7 micrometers, preferably less than 4 micrometers, so as to improve the adhesive property toward cloth and the touch feeling. When the average diameter exceeds 7 micrometers, the adhesion property becomes worse and the products feel rough. The tinge of the pulverized hydrophilic organic natural material can be over a whiteness degree of 70%, when the average particle size is 5 micrometers. The whiteness degree is apt to depending upon the average particle size. It is naturally noted that if a pulverized material has a color, the produced fiber and cloth do not achieve a preferable tinge.

A fiber treatment composition according to this invention should include a 99 –90% synthetic resin emulsion and a 1–10% pulverized hydrophilic organic natural material by weight. Incidentally, the synthetic resin emulsion contains over 8 times by weight water to the pulverized hydrophilic organic natural material. When the emulsion contains less than 8 times by weight water, as the pulverized hydrophilic organic natural material absorbs water and then expands, a desirable emulsion by mixing the two ingredients will not be obtained.

A fiber according to this invention is characterized by being treated by the mentioned fiber treatment composition. A method of this invention has the steps of stirring the fiber treatment composition, soaking a fiber/plain cloth in the treatment composition and drying the soaked fiber/cloth.

The stirring step is carried out in a ball mill, tube mill or by a screw, but preferably, in the ball mill. A general stirring of the two ingredients is not enough to disperse the pulverized materials so that a condensation of the materials is made or the tendency to flake of becomes conspicuous. While, in the ball mill, a dispersion of the pulverized material is enough and an osmotic action to the material and the adhesion property to cloth can be improved since a pressure is produced in the mill. The ball mill is further effective in crushing the pulverized hydrophilic organic natural material, which causes an improvement in texture.

A pad method or a spray method can be used as the soaking process.

A preferable temperature in the drying step is from 80 to 160 degrees, preferably from 100 to 120 degrees. The pulverized hydrophilic organic natural material with water therein has a tendency to be highly hydrolyzed, give off a bad smell and change its color under a high temperature. While under a low heating temperature, a rather long time for heating is needed so that the working efficiency becomes bad.

DETAILED DESCRIPTION OF THE PREFERRED EMBODIMENT(S)

Figure 1:
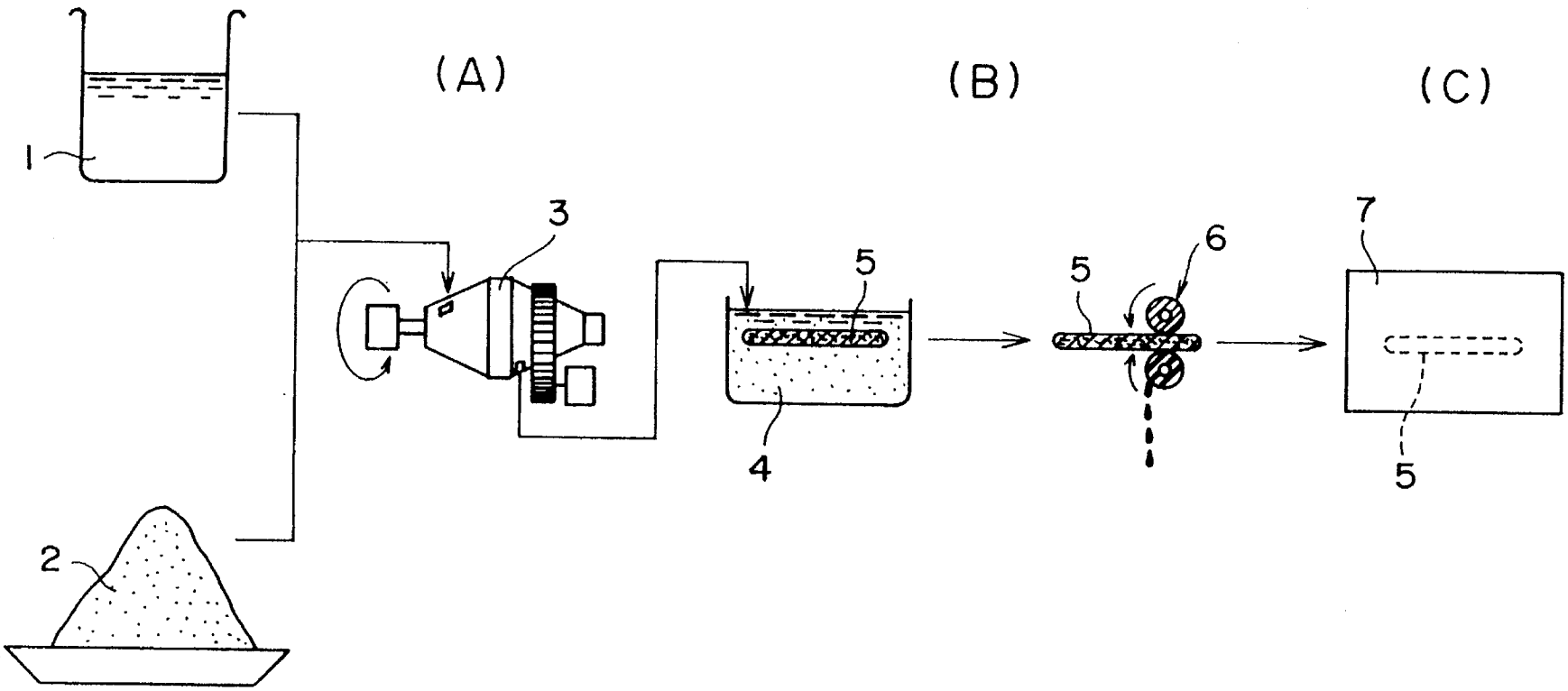
FIG. 1 is a diagrammatic view explaining a fiber/cloth processing method according to the present invention.

The mentioned objects of the present invention will become more fully apparent with reference to the following experimental examples, control examples and FIG. 1 which relate to the preferred embodiment of the present invention.

EXPERIMENTAL EXAMPLE 1

An emulsion solution 1 is prepared by diluting, in 247 grams of water, 100 grams silicon AMZ (13% synthetic resin ingredient, Manufacturer:NIKKA KAGAKU) as an amino-denatured silicon group resin, a solid matter of which will be finished in a film shape. Into the prepared solution 1, 13 grams of pulverized collagen 2 having an average particle diameter of 5 micrometers is added, and the mixture is stirred for 10 minutes by means of a ball mill 3 (The epicycle ball mill produced by SEISHIN CORPORATION) at 150 revolutions per minute, which is denoted by (A) step in FIG. 1.

Succeedingly, 27 grams of a nylon plain cloth for stocking 5 is first soaked in a fiber/cloth treatment composition 4 which is prepared in the ball mill 3 and then transferred into a mangle 6 with a bite pressure of 1 kilogram per square centimeter between a pair of the accompanied rollers in order to remove an excess treatment, which is so called a pad process for an adhesion of the composition to cloths as denoted by (B) step in the drawing. The mangle 6 is a machine for wringing the wet cloth dry using a pair of rollers, one being made from metal and the other from rubber. In this step, 36 grams treatment composition 4 (2.6 grams solid matter thereof) is used for the cloth 5.

The processed cloth for stocking 5 is then transferred into a drying machine 6, which is denoted by step (C) in the drawing. Incidentally, this drying step takes place for 5 minutes at a temperature of 120 degrees.

EXPERIMENTAL EXAMPLE 2

This example was carried out in almost the same manner as in the mentioned experimental example 1 except a stirring process by means of a general screw was used instead of the ball mill.

EXPERIMENTAL EXAMPLE 3

This example is carried out in almost the same manner as in the mentioned experimental example 1 except an adhesion process was performed, instead of the soaking process, by spraying the treatment on the cloth so that the sprayed treatment does not drip.

EXPERIMENTAL EXAMPLE 4

This example was carried out in almost the same manner as in the mentioned experimental example 1 except the pulverized collagen 2 had an average particle diameter of 7 micrometers.

EXPERIMENTAL EXAMPLE 5

This example was carried out in almost the same manner as in the mentioned experimental example 1 except the pulverized collagen 2 had an average particle diameter of 4 micrometers.

EXPERIMENTAL EXAMPLE 6

This example was carried out in almost the same manner as in the mentioned experimental example 1 except the amino-denatured silicon group resin emulsion 1 was made of 100 grams silicon AMZ, 246.5 grams water and 38.5 grams pulverized collagen 2.

EXPERIMENTAL EXAMPLE 7

This example was carried out in almost the same manner as in the mentioned experimental example 1 except that an amino-denatured silicon group resin emulsion 1 made by 100 grams silicon AMZ, 17 grams water and 13 grams pulverized collagen 2 was added into the emulsion 1.

EXPERIMENTAL EXAMPLE 8

This example was carried out in almost the same manner as in the mentioned experimental example 1 except the drying temperature was 100 degrees.

EXPERIMENTAL EXAMPLE 9

This example was carried out in almost the same manner as in the mentioned experimental example 1 except the drying temperature was 80 degrees.

EXPERIMENTAL EXAMPLE 10

This example was carried out in almost the same manner as in the mentioned experimental example 1 except the drying temperature was 160 degrees.

EXPERIMENTAL EXAMPLE 11

In this experimental example, 34.2 grams of oiled amino-denatured silicon group resin (SM8702 silicon produced by TORAI-DAUCAUNING) was employed instead of the amino-denatured silicon group resin, the solid matter of which becomes a film, and 312.8 grams of water was used. Except for these differences, this example was carried out in almost the same manner as in the mentioned experimental example 1.

EXPERIMENTAL EXAMPLE 12

In this experimental example, 34.2 grams of a silicon resin (SH8710 silicon produced by TORAI-DAUCAUNING), which was not amino-denatured was employed instead of the amino-denatured silicon group resin and 312.8 grams water was used. Except for these differences, this example was carried out in almost the same manner as in the mentioned experimental example 1.

EXPERIMENTAL EXAMPLE 13

26 grams of a polyurethane resin (SUPERFLEX E-2000 produced by DAIICHI KOGYO) was used instead of the silicon resin and 312.8 grams of water was used and, further, 13 grams silk powder was used instead of the pulverized collagen. Except for these conditions, this example was carried out in the almost same manner as in the mentioned experimental example 1.

EXPERIMENTAL EXAMPLE 14

28.9 grams of an acrylic resin (VINYBRAN 1225 produced by NISSHIN KAGAKU INDUSTRY) was used instead of the silicon resin and 318.1 grams water and 13 grams pulverized wool was used instead of the pulverized collagen. Except for these conditions, this example was carried out in almost the same manner as in the mentioned experimental example 1.

EXPERIMENTAL EXAMPLE 15

100 grams of a fluorine group resin (NK GUARD FG-270 produced by NIKKA KAGAKU) was used instead of the silicon resin and 13 grams of sponge powder was used instead of the collagen powder. Except for these conditions, this example was carried out in almost the same manner as in the mentioned experimental example 1.

EXPERIMENTAL EXAMPLE 16

A mixture resin having 21 grams of a silicon resin (SILICON AMZ), 21 grams of a polyurethane resin (SUPERFLEX E-2000) and 305 grams of water were used together instead the emulsion as the silicon group resin and 13 grams of cellulose powder was used instead of the pulverized collagen. Except for these conditions, this example was carried out in almost the same manner as in the mentioned experimental example 1.

EXPERIMENTAL EXAMPLE 17

100 grams of a resin mixture resin (EVAPHENOL N-20 produced by NIKKA KAGAKU) containing a polyester resin and polyurethane resin, instead of the emulsion as the silicon group resin and 13 grams of hemp powder was used instead of the pulverized collagen. Except for these conditions, this example was carried out in almost the same manner as in the mentioned experimental example 1.

CONTROL EXAMPLE 1

The hydrophilic organic group natural material was not used and the stirring process was omitted. Except for these conditions, this control example was carried out in almost the same manner as in the mentioned experimental example 1.

CONTROL EXAMPLE 2

There was no processing of the nylon plain cloth for stocking 5.

CONTROL EXAMPLE 3

A pulverized collagen 2 having an average particle diameter of 8 micrometers was used. Except for this difference, this control example was carried out in almost the same manner as in the mentioned experimental example 1.

CONTROL EXAMPLE 4

A pulverized collagen 2 having an average particle diameter of 10 micrometers was used. Except for this difference, this control example was carried out in almost the same manner as in the mentioned experimental example 1.

CONTROL EXAMPLE 5

This example was carried out in almost the same manner as in the mentioned experimental example 1 except the amino-denatured silicon group resin emulsion 1 was made of 100 grams silicon AMZ, 246.5 grams of water and 40.0 grams of pulverized collagen 2.

CONTROL EXAMPLE 6

This example was carried out in almost the same manner as in the mentioned experimental example 1 except the amino-denatured silicon group resin emulsion 1 was made of 100 grams of silicon AMZ and 4 grams of water.

CONTROL EXAMPLE 7

This example was carried out in almost the same manner as in the mentioned experimental example 1 except the drying temperature was 75 degrees.

CONTROL EXAMPLE 8

This example was carried out in almost the same manner as in the mentioned experimental example 1 except the drying temperature was 165 degrees.

CONTROL EXAMPLE 9

This example was carried out in almost the same manner as in the mentioned experimental example 1 except the drying temperature was 30 degrees.

CONTROL EXAMPLE 10

This example was carried out in almost the same manner as in the mentioned experimental example 1 except the drying temperature was 200 degrees.

The above-mentioned experimental examples 1 to 17 and control examples 1 to 10 are shown in Table 1. The obtained plain cloth for stockings from these examples were evaluated and the results are shown in Table 2. The item of dispersion of treatment was evaluated based upon the quantity of powder remaining on a 200-mesh filter. The adhesion property was evaluated by flicking a processed sample on a black paper and checking the fallen off powder quantity. The touch feeling was evaluated by 10 people based on the dry feeling associated with natural materials or the slimy feeling associated with silicon. The absorption of water property was evaluated under a condition of 40 degrees and 90% RH and the dehumidification of water was done under a condition of 23 degrees and 30% RH. The color change was measured as brightness of color by means of a colorimeter produced by MINOLTA.

TABLE 1

| | SYNTHETIC RESIN EMULSION | HYDRO-PHILIC ORGANIC NATURAL MATERIAL | STIR METHOD | ADHESION METHOD | DRYING METHOD |
|---|---|---|---|---|---|
| Ex. Exam. 1 | AMINO-DE-NATURED (SILICON AMZ) 100 g WATER 247 g | PULVERIZED COLLAGEN WEIGHT 13 g AVERAGE PARTICLE DIAMETER 5 μm | BALL MILL 150 RPM 10 min. | PAD METHOD | 120° C. 5 min. |
| Ex. Exam. 2 | AMINO-DE-NATURED (SILICON AMZ) 100 g WATER 247 g | PULVERIZED COLLAGEN WEIGHT 13 g AVERAGE PARTICLE DIAMETER 5 μm | SCREW | PAD METHOD | 120° C. 5 min. |

TABLE 1-continued

| | SYNTHETIC RESIN EMULSION | HYDRO-PHILIC ORGANIC NATURAL MATERIAL | STIR METHOD | ADHESION METHOD | DRYING METHOD |
|---|---|---|---|---|---|
| Ex. Exam. 3 | AMINO-DE-NATURED (SILICON AMZ) 100 g WATER 247 g | PULVERIZED COLLAGEN WEIGHT 13 g AVERAGE PARTICLE DIAMETER 5 μm | BALL MILL | SPRAY METHOD | 120° C. 5 min. |
| Ex. Exam. 4 | AMINO-DE-NATURED (SILICON AMZ) 100 g WATER 247 g | PULVERIZED COLLAGEN AVERAGE PARTICLE DIAMETER 7 μ | BALL MILL | PAD METHOD | 120° C. 5 min. |
| Ex. Exam. 5 | AMINO-DE-NATURED (SILICON AMZ) 100 g WATER 247 g | PULVERIZED COLLAGEN AVERAGE PARTICLE DIAMETER 4 μ | BALL MILL | PAD METHOD | 120° C. 5 min. |
| Ex. Exam. 6 | AMINO-DE-NATURED SILICON RESIN EMULSION FINISHED IN FILM SHAPE (SILICON AMZ) 100 g WATER 246.5 g | PULVERIZED COLLAGEN WEIGHT 38.5 g AVERAGE PARTICLE DIAMETER 5 μm | BALL MILL | PAD METHOD | 120° C. 5 min. |
| Ex. Exam. 7 | AMINO-DE-NATURED SILICON RESIN EMULSION FINISHED IN FILM SHAPE (SILICON AMZ) 100 g WATER 17 g | PULVERIZED COLLAGEN WEIGHT 13 g AVERAGE PARTICLE DIAMETER 5 μm | BALL MILL | PAD METHOD | 120° C. 5 min. |
| Ex. Exam. 8 | AMINO-DE-NATURED SILICON RESIN EMULSION FINISHED IN FILM SHAPE (SILICON AMZ) 100 g WATER 247 g | PULVERIZED COLLAGEN WEIGHT 13 g AVERAGE PARTICLE DIAMETER 5 μm | BALL MILL | PAD METHOD | 100° C. 5 min. |
| Ex. Exam. 9 | AMINO-DE-NATURED SILICON RESIN EMULSION FINISHED IN FILM SHAPE (SILICON AMZ) 100 g WATER 247 g | PULVERIZED COLLAGEN WEIGHT 13 g AVERAGE PARTICLE DIAMETER 5 μm | BALL MILL | PAD METHOD | 80° C. |
| Ex. Exam. 10 | AMINO-DE-NATURED SILICON RESIN EMULSION FINISHED IN FILM SHAPE (SILICON AMZ) 100 g WATER 247 g | PULVERIZED COLLAGEN WEIGHT 13 g AVERAGE PARTICLE DIAMETER 5 μm | BALL MILL | PAD METHOD | 160° C. |
| Ex. Exam. 11 | OILED AMINO-DE-NATURED SILICON RESIN (SM8702) 34.2 g WATER 312.8 g | PULVERIZED COLLAGEN WEIGHT 13 g AVERAGE PARTICLE DIAMETER 5 μm | BALL MILL | PAD METHOD | 120° C. 5 min. |
| Ex. Exam. 12 | DIS-AMINO-DE-NATURED SILICON RESIN (SH8710) 34.2 g WATER 312.8 g | PULVERIZED COLLAGEN WEIGHT 13 g AVERAGE PARTICLE DIAMETER 5 μm | BALL MILL | PAD METHOD | 120° C. 5 min. |
| Ex. Exam. 13 | POLYURETHANE RESIN (SUPERFLEX E-2000) 26 g WATER 321 g | SILK POWDER WEIGHT 13 g AVERAGE PARTICLE DIAMETER 5 μm | BALL MILL | PAD METHOD | 120° C. 5 min. |
| Ex. Exam. 14 | ACRYLIC RESIN (VINYBRAN 1225) 28.9 g WATER 318.1 g | PULVERIZED WOOL WEIGHT 13 g AVERAGE PARTICLE DIAMETER 5 μm | BALL MILL | PAD METHOD | 120° C. 5 min. |
| Ex. Exam. 15 | FLUORINE GROUP RESIN (NK GUARD (FG-270) 100 g WATER 247 g | SPONGE POWDER WEIGHT 13 g AVERAGE PARTICLE DIAMETER 5 μm | BALL MILL | PAD METHOD | 120° C. 5 min. |
| Ex. Exam. 16 | SILICON RESIN (SILICON AMZ) 21 g + POLY-URETHANE RESIN | CELLULOSE POWDER WEIGHT 13 g AVERAGE PARTICLE DIAMETER 5 μm | BALL MILL | PAD METHOD | 120° C. 5 min. |

TABLE 1-continued

| | SYNTHETIC RESIN EMULSION | HYDRO-PHILIC ORGANIC NATURAL MATERIAL | STIR METHOD | ADHESION METHOD | DRYING METHOD |
|---|---|---|---|---|---|
| | (SUPERFLEX E-2000) 21 g WATER 305 g | | | | |
| Ex. Exam. 17 | POLYESTER RESIN + POLY-URETHANE RESIN (EVAPHENOL N-20) 100 g WATER 247 g | HEMP POWDER WEIGHT 13 g AVERAGE PARTICLE DIAMETER 5 μm | BALL MILL | PAD METHOD | 120° C. 5 min. |
| Con. Exam. 1 | AMINO-DE NATURED SILICON RESIN EMULSION FINISHED IN FILM SHAPE (SILICON AMZ) 100 g WATER 247 g | — | — | PAD METHOD | 120° C. 5 min. |
| Con. Exam. 2 | — | — | — | — | — |
| Con. Exam. 3 | AMINO-DE-NATURED SILICON RESIN EMULSION FINISHED IN FILM SHAPE (SILICON AMZ) 100 g WATER 247 g | PULVERIZED COLLAGEN WEIGHT 13 g AVERAGE PARTICLE DIAMETER 8 μm | BALL MILL 150 RPM 10 min. | PAD METHOD | 120° C. 5 min. |
| Con. Exam. 4 | AMINO-DE-NATURED SILICON RESIN EMULSION FINISHED IN FILM SHAPE (SILICON AMZ) 100 g WATER 247 g | PULVERIZED COLLAGEN AVERAGE PARTICLE DIAMETER 10 μm | BALL MILL 150 RPM 10 min. | PAD METHOD | 120° C. 5 min. |
| Con. Exam. 5 | AMINO-DE-NATURED SILICON RESIN EMULSION FINISHED IN FILM SHAPE (SILICON AMZ) 100 g WATER 246.5 g | PULVERIZED COLLAGEN WEIGHT 40.0 g AVERAGE PARTICLE DIAMETER 5 μm | BALL MILL 150 RPM 10 min. | PAD METHOD | 120° C. 5 min. |
| Con. Exam. 6 | AMINO-DE-NATURED SILICON RESIN EMULSION FINISHED IN FILM SHAPE (SILICON AMZ) 30.8 g WATER 0 g | PULVERIZED COLLAGEN WEIGHT 40.0 g AVERAGE PARTICLE DIAMETER 5 μm | BALL MILL 150 RPM 10 min. | PAD METHOD | 120° C. 5 min. |
| Con. Exam. 7 | AMINO-DE-NATURED SILICON RESIN EMULSION FINISHED IN FILM SHAPE (SILICON AMZ) 100 g WATER 247 g | PULVERIZED COLLAGEN WEIGHT 13 g AVERAGE PARTICLE DIAMETER 5 μm | BALL MILL 150 RPM 10 min. | PAD METHOD | 75° C. 5 min. |
| Con. Exam. 8 | AMINO-DE-NATURED SILICON RESIN EMULSION FINISHED IN FILM SHAPE (SILICON AMZ) 100 g WATER 247 g | PULVERIZED COLLAGEN WEIGHT 13 g AVERAGE PARTICLE DIAMETER 5 μm | BALL MILL 150 RPM 10 min. | PAD METHOD | 165° C. |
| Con. Exam. 9 | AMINO-DE-NATURED SILICON RESIN EMULSION FINISHED IN FILM SHAPE (SILICON AMZ) 100 g WATER 247 g | PULVERIZED COLLAGEN WEIGHT 13 g AVERAGE PARTICLE DIAMETER 5 μm | BALL MILL 150 RPM 10 min. | PAD METHOD | 30° C. |
| Con. Exam. 10 | AMINO-DE-NATURED SILICON RESIN EMULSION FINISHED IN FILM SHAPE (SILICON AMZ) 100 g WATER 247 g | PULVERIZED COLLAGEN WEIGHT 13 g AVERAGE PARTICLE DIAMETER 5 μm | BALL MILL 150 RPM 10 min. | PAD METHOD | 200° C. |

Ex. Exam. = Experimental Example
Con. Exam. = Control Example

TABLE 2

| | DISPERSION OF TREATMENT | PROCESSED SAMPLE | | | |
|---|---|---|---|---|---|
| | | ADHESION | TOUCH | HYGRO-SCOPICITY | COLOR CHANGE |
| EX. Exam. 1 | 5 | 5 | 5 | 5 | 5 |
| Ex. Exam. 2 | 3 | 4 | 5 | 5 | 5 |
| Ex. Exam. 3 | 5 | 5 | 5 | 5 | 5 |
| Ex. Exam. 4 | 5 | 4 | 5 | 5 | 5 |
| Ex. Exam. 5 | 5 | 5 | 5 | 5 | 5 |
| Ex. Exam. 6 | 5 | 5 | 5 | 5 | 5 |
| Ex. Exam. 7 | 5 | 5 | 5 | 5 | 5 |
| Ex. Exam. 8 | 5 | 5 | 5 | 5 | 5 |
| Ex. Exam. 9 | 5 | 5 | 5 | 5 | 5 |
| Ex. Exam. 10 | 5 | 5 | 4 | 5 | 4 |
| Ex. Exam. 11 | 5 | 5 | 5 | 5 | 5 |
| EX. Exam. 12 | 5 | 5 | 5 | 5 | 5 |
| EX. Exam. 13 | 5 | 5 | 5 | 5 | 5 |
| EX. Exam. 14 | 5 | 5 | 5 | 5 | 5 |
| Ex. Exam. 15 | 5 | 5 | 5 | 5 | 5 |
| Ex. Exam. 16 | 5 | 5 | 5 | 5 | 5 |
| Ex. Exam. 17 | 5 | 5 | 5 | 5 | 5 |
| Con. Exam. 1 | — | — | 3 | 3 | — |
| Con. Exam. 2 | — | — | 2 | 3 | — |
| Con. Exam. 3 | 5 | 2 | 3 | 5 | 5 |
| Con. Exam. 4 | 5 | 2 | 2 | 5 | 5 |
| Con. Exam. 5 | 2 | 4 | 5 | 5 | 5 |
| Con. Exam. 6 | 3 | 3 | 4 | 5 | 5 |
| Con. Exam. 7 | 5 | 3 | 3 | 4 | 5 |
| Con. Exam. 8 | 5 | 5 | 4 | 5 | 2 |
| Con. Exam. 9 | 5 | 3 | 3 | 4 | 5 |
| Con. Exam. 10 | 5 | 5 | 4 | 5 | 1 |

Ex. Exam. = Experimental Example
Con. Exam. = Control Example
DETERMINATION
1. WORSE
2. BAD
3. AVERAGE
4. GOOD
5. BETTER According to the present fiber/cloth treatment composition, a high adhesion property, natural dry feeling and hygroscopicity in plain cloth can be obtained without the hindrance of aeration in the cloth. The durability of the cloth because of the high adhesion and the hygroscopicity of the cloth can be improved.

What is claimed is:

1. A fiber treatment composition comprising 90–99 wt. % of a synthetic resin emulsion and 10-1 wt. % of a pulverized hydrophilic organic natural material, said synthetic resin emulsion being selected from the group consisting of a silicon resin emulsion, a polyurethane resin emulsion, a polyacrylic resin emulsion, a fluorine resin emulsion and mixtures thereof, said synthetic resin emulsion containing at least 8 times the weight of water of the weight of the pulverized hydrophilic organic natural material present in the fiber treatment composition, said pulverized hydrophilic organic natural material having an average particle size not exceeding 7 microns in diameter and a standard deviation of 3 microns.

2. A fiber treatment composition according to claim 1, wherein said pulverized hydrophilic organic natural material is selected from the group consisting of collagen, elastin, silk powder, sponge powder, wool, cellulose, cotton, hemp, pulp and seaweed.

3. A fiber treatment composition according to claim 1, wherein said synthetic resin emulsion is an amino-denatured silicon resin emulsion and said pulverized hydrophilic organic natural material is selected from the group consisting of sponge powder, wool, cellulose, hemp, pulp and seaweed.

4. A fiber treatment composition according to claim 1, wherein said pulverized hydrophilic organic natural material is a pulverized collagen.

5. A fiber treatment composition according to claim 1, wherein said synthetic resin emulsion is a silicon resin emulsion.

6. A fiber treatment composition according to claim 5, wherein said silicon resin emulsion is amino-denatured.

7. A fiber treatment composition according to claim 6, wherein said amino-denatured silicon resin has solid matter in a film form.

8. A fiber treatment composition according to claim 1, wherein said synthetic resin emulsion is a polyurethane resin emulsion.

9. A fiber treatment composition comprising 90–99 wt. % of an amino-denatured silicon resin emulsion and 10-1 wt. % of pulverized collagen, said amino-denatured silicon resin emulsion containing at least 8 times the weight of water of the weight of the pulverized collagen present in the fiber treatment composition, said collagen having an average particle size not exceeding 7 microns in diameter and a standard deviation of 3 microns.

10. A fiber treatment composition comprising 90–99 wt. % of an amino-denatured silicon resin emulsion and 10-1 wt. % of pulverized silk powder, said amino-denatured silicon resin emulsion containing at least 8 times the weight of water of the weight of the pulverized silk powder present in the fiber treatment composition, said silk powder having an average particle size not exceeding 7 microns in diameter and a standard deviation of 3 microns.

11. A fiber treatment composition according to claim 1, wherein said pulverized hydrophilic organic natural material has an average particle size of less than 4 microns.

12. A fiber treatment composition according to claim 9, wherein said pulverized hydrophilic organic natural material has an average particle size of less than 4 microns.

13. A fiber treatment composition according to claim 10, wherein said pulverized hydrophilic organic natural material has an average particle size of less than 4 microns.

14. A fiber treatment composition according to claim 1, wherein said composition consists essentially of said synthetic resin emulsion and said pulverized hydrophilic organic natural material.

15. A fiber treatment composition according to claim 9, wherein said composition consists essentially of said amino-denatured silicon resin emulsion and said pulverized collagen.

16. A fiber treatment composition according to claim 10, wherein said composition consists essentially of said amino-denatured silicon resin emulsion and said pulverized silk.

* * * * *